US006880674B1

(12) United States Patent
St-Hilaire

(10) Patent No.: US 6,880,674 B1
(45) Date of Patent: Apr. 19, 2005

(54) GATE FOR ABOVE GROUND POOL STEPS

(76) Inventor: Normand St-Hilaire, 424 Boul. Ste-Anne, Ste-Anne des Plaines, QC (CA), J0N 1H0

( * ) Notice: Subject to any disclaimer, the term of this patent is extended or adjusted under 35 U.S.C. 154(b) by 0 days.

(21) Appl. No.: 10/715,755

(22) Filed: Nov. 18, 2003

(51) Int. Cl.[7] ..... E06C 7/18; E04G 1/00
(52) U.S. Cl. ..... 182/106; 182/129
(58) Field of Search ..... 182/129, 230, 182/106, 104; 49/501

(56) References Cited

U.S. PATENT DOCUMENTS 3,225,863 A * 12/1965 Ludlow ..... 182/230
3,968,857 A * 7/1976 Bryan ..... 182/106
4,579,197 A * 4/1986 Spurling ..... 182/106

* cited by examiner

*Primary Examiner*—Hugh B. Thompson, II
(74) *Attorney, Agent, or Firm*—Eric Fincham

(57) ABSTRACT

A door ladder assembly for use with the an above ground swimming pool, the assembly comprising a ladder having a plurality of steps, a door with a first side hingedly connected to one side of the ladder and arranged to hingedly move between open and closed positions, a handle being located at the top portion of the door, and a door lock to lock the door in a closed position, the door being provided with a lock operator to unlock the lock, the lock operator being located proximate the handle. The arrangement provides for easy access for an adult, while preventing a child from having access to the unlocking mechanism.

6 Claims, 4 Drawing Sheets

GATE FOR ABOVE GROUND POOL STEPS

FIELD OF THE INVENTION

The present invention relates to ladders and more particularly, relates to a ladder structure for an above ground swimming pool.

BACKGROUND OF THE INVENTION

The use of ladders for above ground swimming pools is essential when there is not provided any deck or other mechanism for gaining access to the swimming pool. However, it is also necessary to be able to prevent climbing access to the ladders. This is particularly the case with children since ladders are attractive to small children. Not only do the children run the risk of injury while climbing, but also a risk of drowning if access is gained to the interior of the swimming pool.

The need for ladder guards is well recognized in the art and there have been many proposals for such devices.

Most of the guards have been designed as a retrofit for existing pool ladders. Thus, in U.S. Pat. No. 4,579,197, there is disclosed a safety device for use with above ground swimming pools. The flat shield is gravity supported at the base of the ladder. It rests against the ladder and is secured by a locking bar that slips through two holes in the side of the shield behind the ladder. However, it will not accommodate wider or narrower ladders and must rest on the ground and is of limited suitability.

U.S. Pat. No. 3,311,195 to Singer discloses a ladder guard for above ground swimming pools. It consists of a flat panel, covering ladder steps to prevent young children from climbing up the ladder into the pool area. However, it does not provide for locking and can be easily removed even by children.

A desirable feature of a ladder for an above ground swimming pool is one which would normally be in a locked position, but is easily opened and permits access by adults, but not the children. It would also be desirable if the ladder guard could be utilized while occupying the pool while still permitting opening of the guard for ingress and egress to and from the swimming pool.

SUMMARY OF THE INVENTION

It is an object of the present invention to provide an integrated ladder and ladder guard assembly suitable for use with above ground swimming pools.

It is a further object of the present invention to provide a ladder and ladder guard which resists opening by small children while permitting easy access to a swimming pool by an adult.

According to one aspect of the present invention, there is provided a door ladder assembly suitable for use with an above ground swimming pool, the assembly comprising a ladder having a plurality of steps, a door having a first side hingedly connected to one side of said ladder and arranged to hingedly move between opened and closed positions, a handle located at the top portion of the door, a door lock to lock the door in a closed position, and a lock operator to lock and unlock the door lock, the lock operator being located proximate the handle.

In a further aspect of the present invention there is provided, in combination, an above ground swimming pool and a ladder assembly therefor, the above ground swimming pool having a base and at least one wall extending thereabout, the ladder assembly comprising a first set of steps exterior of the pool, a second set of steps interior of the pool, said steps meeting at an upper end thereof, a door having a first side hingedly connected to one side of said set of steps exterior of the pool and arranged to hingedly move between open and closed positions, a handle located at the top portion of the door, a door lock to lock the door in a closed position, and a lock operator to lock and unlock the door lock, the lock operator being located proximate the handle.

In a greater detail, the door ladder assembly of the present invention may be used either with a single set of steps which would extend from the ground or other substrate to the top of the pool wall, or, in the preferred embodiment, will comprise a second ladder portion interior of the pool extending from the base of the pool to meet the first set of steps. Either arrangement is known in the art.

The door is arranged to prevent access to the steps when in a closed position. As such, the door will extend substantially across the steps from one stile to a second stile of the ladder. The door is hingedly connected to one of the stiles (or proximate thereto) such that it may be moved from a closed position wherein it substantially covers at least a lower portion of the steps to an open position wherein access may be had to the steps for climbing the ladder into the pool. Preferably, the ladder is biased to a closed position. Many biasing means are known in the art and may be utilized including conventional springs and the like.

Preferably, the door is mounted such that access may not easily be had to the sides to open the same. In other words, it is preferred that the door can only easily be opened by means of a handle. In order to prevent access to the handle by small children, the handle is preferably located at the upper portion of the door.

The door is also preferably lockable to further hinder access to the steps. To further ensure the safe operation of the assembly, there is provided a lock actuator which will lock or unlock the door lock. Again, this lock actuator is preferably situated at the upper portion of the door to prevent access thereto by small children while permitting adult access thereto.

The structure of the present invention is described in terms of a ladder which is a conventional arrangement for swimming pools. However, it will be understood that a somewhat larger assembly known as pool steps may also be employed and fall within the scope of the present invention.

BRIEF DESCRIPTION OF THE DRAWINGS

Having thus generally described the invention, reference will be made to the accompanying drawings, illustrating an embodiment thereof, in which.

DESCRIPTION OF THE PREFERRED EMBODIMENTS

Figure 1:
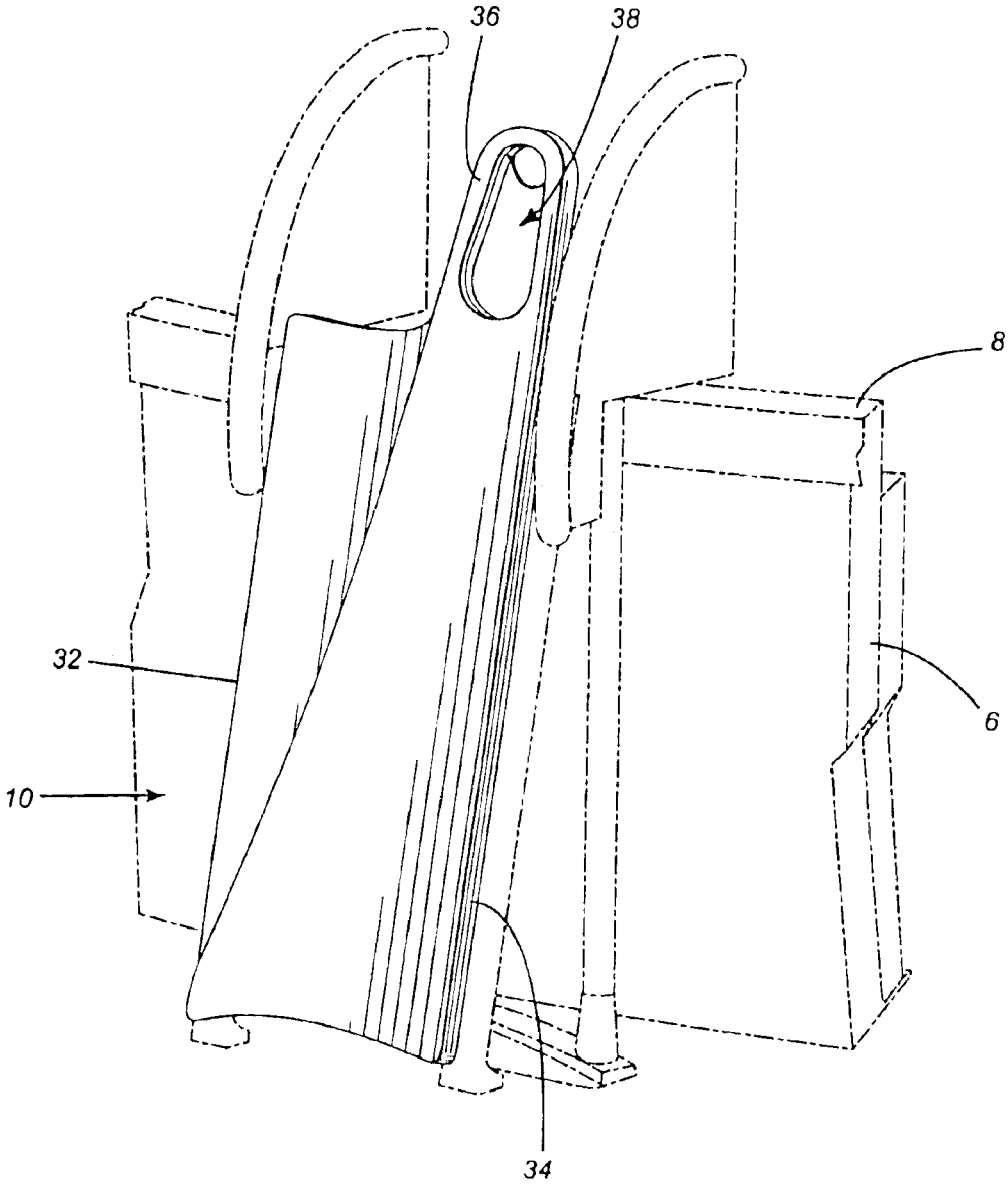
FIG. 1 is a perspective view of the ladder and door assembly, the door being in a closed position and illustrating its use in a swimming pool.
Figure 2:
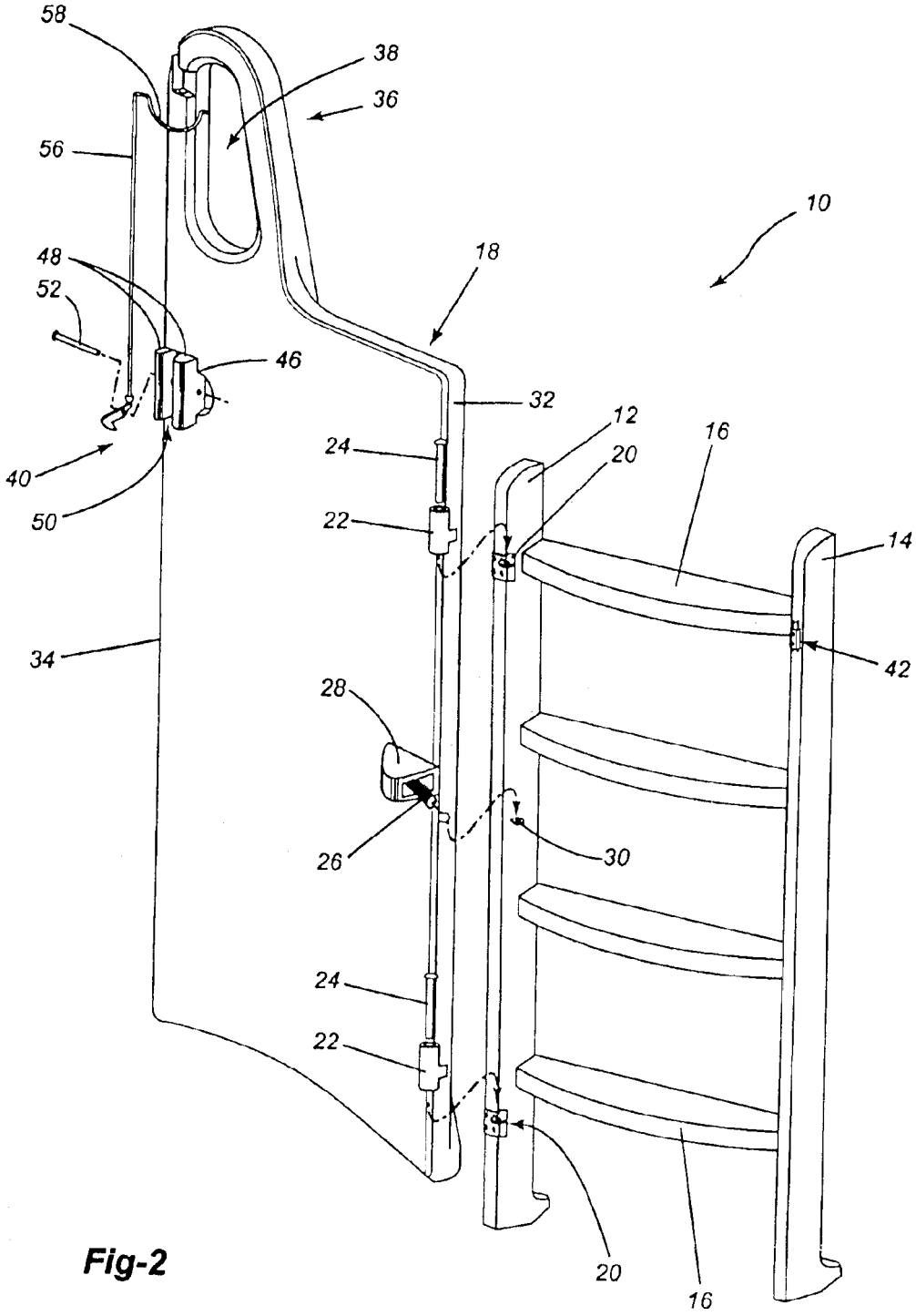
FIG. 2 is a perspective view of the ladder and door assembly with the door being shown in an open position and detached from the ladder.
Figure 3:
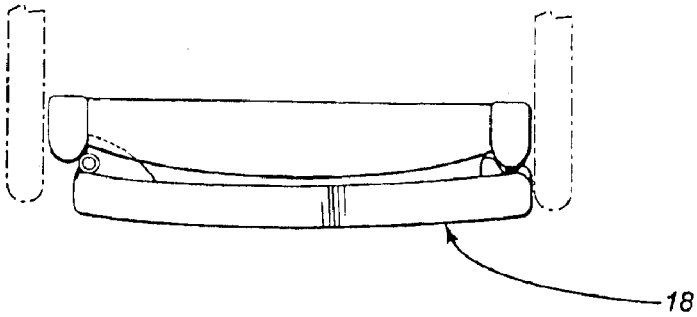
FIG. 3 is a top plan view thereof, the door being in a closed position.
Figure 4:
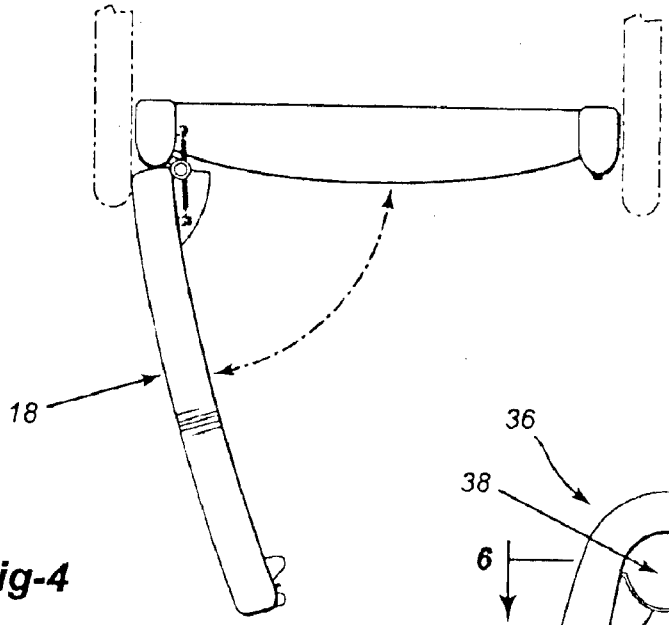
FIG. 4 is a top plan view with the door being in a open position.
Figure 5:
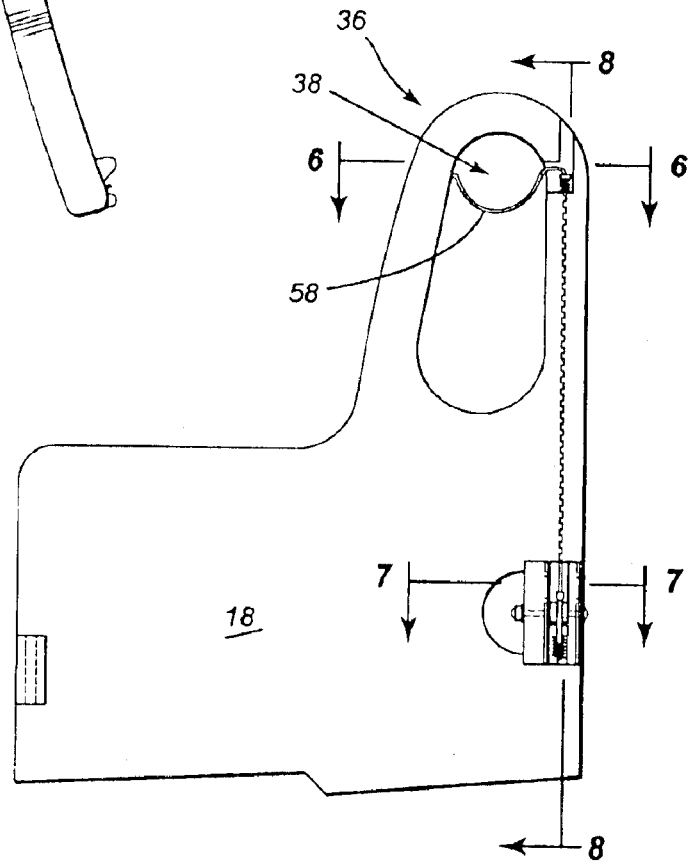
FIG. 5 is a rear view of the upper portion of the door.
Figure 6:
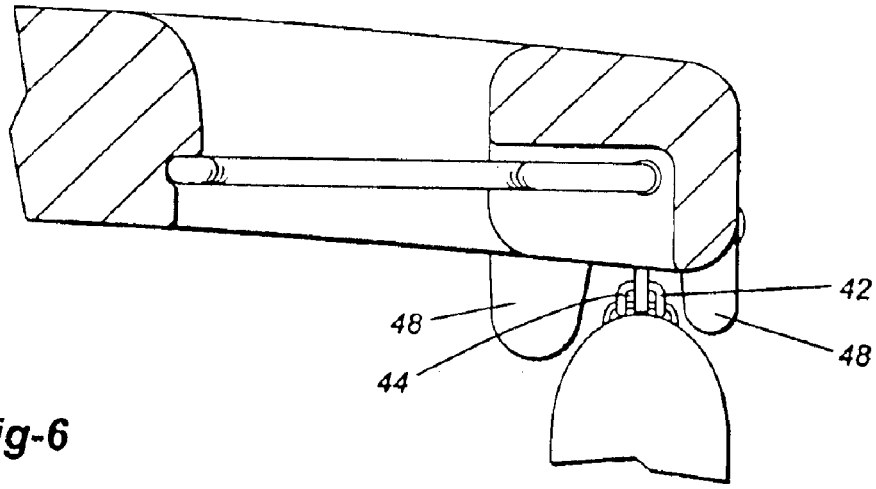
FIG. 6 a sectional view taken along the lines 6—6 of FIG. 5.
Figure 7:
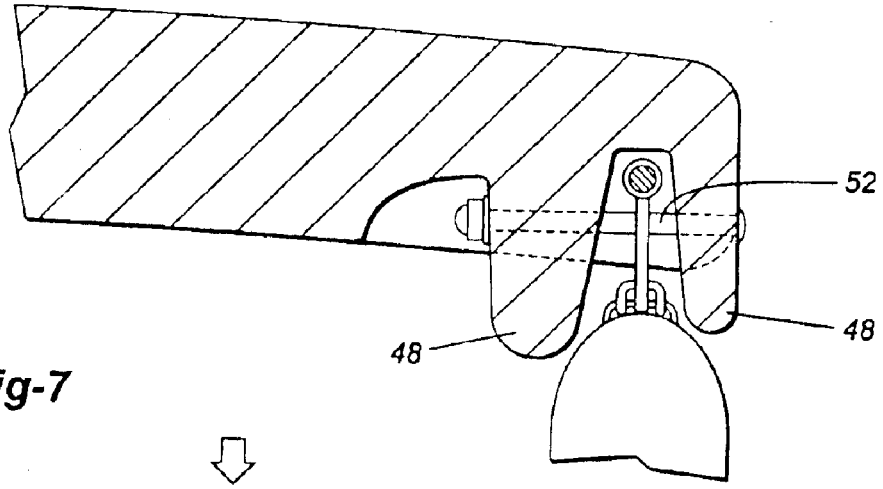
FIG. 7 is a sectional view taken along the lines 7—7 of FIG. 5.

Referring to the drawings in greater detail and by reference characters thereto, the ladder and door assembly of the present invention are generally designated by reference numeral 10.

Assembly 10 includes a ladder having a pair of stile members 12, 14 between which extend a plurality of rungs or steps 16.

The door portion is generally designated by reference numeral 18 and has a first side 32 and a second side 34. At first side 32, there is provided a pair of door hinge components 22 which interface with ladder hinge components 20. In a conventional manner, pins 24 are utilized for connecting the hinge components.

A spring member 26 urges or biases the door to a closed position, and to this end, is attached to door 18 within a housing 28 and to side 32 of the ladder by means of a hook 30.

The door 18 has an upper extension generally designated by reference numeral 36 and which includes an apertured portion 38 which permits a user to open and close the door. In this respect, apertured portion 38 is located such that access may be had thereto only by an individual sufficiently tall to reach the same.

There is also provided a lock mechanism generally designated by reference numeral 40. Lock mechanism 40 includes a stile lock component 42 which is a ring like member secured through the stile and having an aperture 44 formed therein.

The second part of the lock mechanism 40 comprises a housing 46 secured to an inner portion of door 18. Housing 46 includes a pair of vertical members 48 having a channel 50 formed therein. Side members 48 are designed to receive a pin 52.

Locking mechanism 40 also includes a hook like member 54 which is secured in position by means of pin 52 to form a pivot point 62. Hook member 54 is designed to engage at one end thereof, with aperture 44 of stile lock component 42.

Located at an upper end of rod 56 is a handle portion 58. A spring member 60 is utilized to bias hook member 54 into engagement with stile lock component 42.

Figure 8:
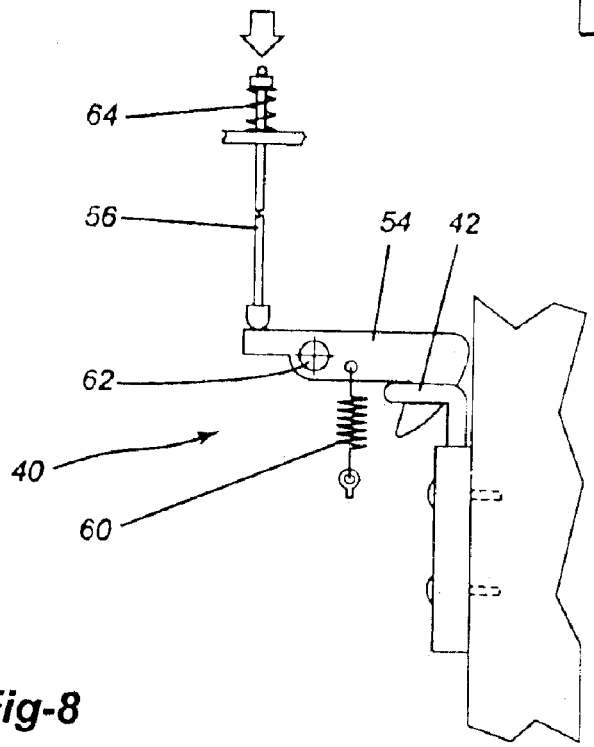
FIG. 8 is a cross-sectional view taken along the lines 8—8 of FIG. 5.

As may be seen in FIG. 8, pressure on rod 56 as indicated by arrow 66 will cause hook 54 to disengage from stile lock component 42.

It will be understood that the above described embodiment is for purposes of illustration only and that changes and modifications may be made thereto without departing for the spirit and scope of invention.

I claim:

1. A door ladder assembly suitable for use with an above ground swimming pool, the assembly comprising:

a ladder having a plurality of steps;

a door having a first side hingedly connected to one side of said ladder and arranged to hingedly move between opened and closed positions;

a handle located at a top portion of said door, said handle comprising an upwardly extended door portion having an aperture therein to permit grabbing of said door to move said door between said opened and closed positions;

a door lock to lock said door in a closed position; and a lock operator to lock and unlock said lock, said lock operator being located proximate said handle.

2. The assembly of claim 1 wherein said lock is located on a second side of said door.

3. A door ladder assembly suitable for use with an above ground swimming pool, the assembly comprising:

a ladder having a plurality of steps;

a door having a first side hingedly connected to one side of said ladder and arranged to hingedly move between opened and closed positions;

door biasing means such that said door is biased to urge said door towards a closed position; and a lock operator to lock and unlock said lock, said lock operator being located proximate said handle.

4. The assembly of claim 3 further including lock biasing means to bias said lock operator to a position to cause said lock to be in a locked position.

5. The assembly of claim 3 wherein said door biasing means comprises a spring member connected to said door.

6. A door ladder assembly suitable for use with an above ground swimming pool, the assembly comprising:

a ladder having a plurality of steps;

a door having a first side hingedly connected to one side of said ladder and arranged to hingedly move between opened and closed positions;

a handle located at a top portion of said door;

a door lock to lock said door in a closed position;

a lock operator to lock and unlock said lock, said lock operator being located proximate said handle; and lock biasing means to bias said lock operator to a position to cause said lock to be in a locked position.

* * * * *